US012343596B2

(12) United States Patent
Plaze et al.

(10) Patent No.: US 12,343,596 B2
(45) Date of Patent: Jul. 1, 2025

(54) CAMMING CLAMPING DEVICE AND METHOD FOR MANUFACTURING ONE SUCH DEVICE AND METHOD FOR REPLACING A WIRE ELEMENT OF ONE SUCH DEVICE

(71) Applicant: ZEDEL, Crolles (FR)

(72) Inventors: Pierre Plaze, Chignin (FR); Aurélie Bergez, Gières (FR); Alain Maurice, Plateau des Petites Roches (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 18/538,412

(22) Filed: Dec. 13, 2023

(65) Prior Publication Data

US 2024/0207684 A1 Jun. 27, 2024

(30) Foreign Application Priority Data

Dec. 22, 2022 (FR) ..... 2214297

(51) Int. Cl.
*A63B 29/02* (2006.01)
*A63B 29/00* (2006.01)

(52) U.S. Cl.
CPC ..... *A63B 29/024* (2013.01); *A63B 29/00* (2013.01)

(58) Field of Classification Search
CPC ..... A63B 29/024; A63B 29/00; A63B 29/02; A63B 29/08; A47F 5/08
USPC ..... 248/544, 231, 231.91, 925, 694; 294/28, 294/94, 95, 96, 106, 19.1, 100
See application file for complete search history.

(56) References Cited

U.S. PATENT DOCUMENTS

| | | | |
|---|---|---|---|
| 4,184,657 | A | 1/1980 | Jardine |
| 4,513,641 | A | 4/1985 | Murray et al. |
| 4,565,342 | A | 1/1986 | Grow |
| 4,575,032 | A | 3/1986 | Taylor |
| 4,645,149 | A | 2/1987 | Lowe |
| 4,832,289 | A | 5/1989 | Waggoner |
| 5,860,629 | A | 1/1999 | Reed |

(Continued)

FOREIGN PATENT DOCUMENTS

| | | | |
|---|---|---|---|
| DE | 28 24 654 | A1 | 12/1978 |
| DE | 102015213205 | A1 | 1/2017 |

(Continued)

OTHER PUBLICATIONS

U.S. Appl. No. 18/543,947, filed Dec. 18, 2023 in the name of Plaze et al.

(Continued)

*Primary Examiner* — Nkeisha Smith
(74) *Attorney, Agent, or Firm* — Oliff PLC

(57) ABSTRACT

A camming clamping device comprising: a head sub-assembly including a head provided with a cam and a rod sub-assembly having a rod and at least one wire element. The wire element passes through the rod. The rod delineates a through hole designed to receive a connector. The wire element delineates the through hole. The wire element defines at least one loop that is attached to head to constitute a mechanical continuity between the head and the attachment point. The at least one loop is passed through by a tube.

(Continued)

The tube and the at least one loop are passed through by an anchorage fixed to the head to constitute the mechanical continuity between the head and the attachment point.

13 Claims, 5 Drawing Sheets

(56) References Cited

U.S. PATENT DOCUMENTS

| | | | | |
|---|---|---|---|---|
| 6,679,466 | B2 * | 1/2004 | Brown | A63B 29/024 248/231.9 |
| 6,736,359 | B2 * | 5/2004 | Murray | A63B 29/024 482/37 |
| 7,278,618 | B2 * | 10/2007 | Tusting | A63B 29/024 248/231.91 |
| 9,302,154 | B2 * | 4/2016 | Steck | A63B 29/024 |
| 10,143,892 | B2 * | 12/2018 | Baker | A63B 29/024 |
| 10,463,916 | B2 * | 11/2019 | Davidson | A63B 29/024 |
| 11,383,136 | B2 | 7/2022 | Steck et al. | |
| 2004/0035992 | A1 | 2/2004 | Watts | |
| 2006/0231708 | A1 | 10/2006 | Robertson et al. | |
| 2015/0001360 | A1 | 1/2015 | Czech | |
| 2020/0034075 | A1 | 1/2020 | Li et al. | |
| 2021/0001181 | A1 | 1/2021 | Steck et al. | |

FOREIGN PATENT DOCUMENTS

| | | | |
|---|---|---|---|
| DE | 112020005469 | T5 | 9/2022 |
| EP | 0 226 829 | A1 | 7/1987 |
| ES | 2639103 | T3 | 10/2017 |
| GB | 2 158 540 | A | 11/1985 |
| GB | 2 369 068 | A | 5/2002 |
| GB | 2 380 949 | A | 4/2003 |
| GB | 2 461 807 | A | 1/2010 |
| WO | 2014152150 | A1 | 9/2014 |

OTHER PUBLICATIONS

U.S. Appl. No. 18/537,908, filed Dec. 13, 2023 in the name of Plaze et al.

Nov. 25, 2024 Office Action issued in U.S. Appl. No. 18/537,908.

Feb. 25, 2025 Non-Final Rejection received in U.S. Appl. No. 18/543,947.

Apr. 9, 2025 U.S. Office Action issued in U.S. Appl. No. 18/537,908.

* cited by examiner

CAMMING CLAMPING DEVICE AND METHOD FOR MANUFACTURING ONE SUCH DEVICE AND METHOD FOR REPLACING A WIRE ELEMENT OF ONE SUCH DEVICE

BACKGROUND OF THE INVENTION

The invention relates to a camming clamping device, to a method for manufacturing a camming clamping device and to a method for replacing a wire element of a camming clamping device.

PRIOR ART

During the climbing phases, a climber is required to place protection points in a rockface. The climber successively installs several protection points that are designed to support him in case of a fall. Certain rockfaces are equipped with pre-installed protection points, for example in the form of spits that are sealed in the rock. Other rockfaces are not equipped with such points so that the climber has to find the crevice that is most suitable for installing his protection point.

When the climber has to place his/her protection points, it is conventional practice to install passive chocks and active chocks. The chocks are designed to be inserted in crevices that are generally holes, cracks, channels or any other recess that is deep enough for a chock to be inserted. Each particular shape of crevice is suitable for a particular chock configuration. In conventional manner, for chocks, the head is arranged at a first end and is designed to wedge. The opposite end defines a through hole designed to receive a carabiner. The through hole is generally delineated by a steel cable. The steel cable is sunk at one or more places in the head and/or it is crimped to define the ring designed to receive the carabiner.

Passive chocks are often formed by metal parts having a specific shape. In passive chocks, the volume is constant or substantially constant throughout its use. In a first spatial position, the chock can be inserted in a fault of a rockface and, in a second spatial position, the chock is wedged between two opposite faces of the fault. It is then possible to install and remove the chock easily or to wedge the chock, provided that the latter is placed in the right spatial configuration inside the hole. For certain types of passive chocks, the steel cable is replaced by a strap made from textile material. The strap forms a ring that is closed by a seam after the strap has passed through the head several times.

The different configurations currently marketed do not provide for replacement of the material or materials forming the ring with respect to the head. Consequently, if the ring is damaged or worn, the whole of the chock has to be replaced.

Historically, it is known to form a ring that is constituted by a strap or a rope that passes through the head sub-assembly and is closed by means of a knot. Closing of the ring by one or more knots gives rise to problems of repeatability and resistance over time, in particular when materials with a low friction coefficient are used, which does not enable the knots to be sustained over time.

In active chocks, one or more cams are stressed to modify the size of the head of the chock. For active chocks, it is also known to wedge one end of a steel cable in a part of the head in irremovable manner. The other end of the cable is shaped to form a loop that is closed by crimping.

Active chocks are also known that use a mechanical connection between the head and the annular end by means of a textile wire element defining a loop by joining the two ends of the wire element by a splicing step. The parts of the rod are passed through by the wire element before the wire element loop is formed. The loop is then fixed to the head of the chock. Such a configuration makes it difficult to secure the textile wire element with the head as the available space is limited and the axes of rotation of the cams are substantially at the same height as the insert so that the insert is located between the cams in the extended position. Furthermore, the rod being formed and the wire element being subjected to a tensile stress, the fixing between the head and the wire element makes the operation complicated.

Such a configuration makes it very difficult or even impossible to replace the wire element if the latter is damaged or at end of life. As the wire element is made from textile material, it ages much more quickly than the head assembly. The lifetime of the chock is then defined by the lifetime of the wire element.

OBJECT OF THE INVENTION

One object of the invention consists in providing a camming clamping device with a mechanical connection between the head and the annular end that is more easily replaceable than the configurations of the prior art.

According to one feature of the invention, the camming clamping device comprises:

- a head sub-assembly including a head provided with at least one cam designed to wedge in a crevice;
- a rod sub-assembly having a rod and at least one wire element, the rod being hollow and being passed through by the at least one wire element, the rod sub-assembly delineating a through hole designed to receive a connector to form an attachment point, the at least one wire element delineating the through hole, the wire element defining at least one loop that is attached to the head sub-assembly to constitute a mechanical continuity between the head and the attachment point.

The camming clamping device is remarkable in that the at least one loop is passed through by a tube and in that the tube and the at least one loop are passed through by an anchorage fixed to the head to constitute the mechanical continuity between the head and the attachment point.

In advantageous manner, the anchorage is removable with respect to the head or destructible independently from the head to allow the head sub-assembly and rod sub-assembly to be separated.

In a particular configuration, the wire element is subjected to a tensile stress in a longitudinal direction of the rod and of the wire element, the rod forming a stop opposing movement of the tube towards the through hole.

In an advantageous development, the wire element has several loops, the loops being passed through by the tube and the anchorage.

Preferentially, the tube is divisible and installed fixedly in the head. Extraction of the tube from the head causes destruction of the tube.

According to one embodiment, the anchorage is a screw. At least one of the head and the tube has a thread receiving a thread of the screw to secure the anchorage with the head.

In an advantageous development, the anchorage is an insert crimped with the head.

Preferentially, the anchorage is a rod fixed to the head by means of an irremovable clip.

In another advantageous development, the wire element is a ring made from textile material.

Preferentially, the wire element is a ring folded to define at least two legs each comprising a top end, a bottom end and two strands, wherein the two strands join one another in the top end to form a loop attached to the head, wherein the bottom end of each leg is extended by a connecting portion, the connecting portion connecting the legs to one another, the connecting portion delineating said through hole, the connecting portion comprising at least four strands of the wire element;

wherein the loops are passed through by the tube.

In advantageous manner, the at least one cam is installed movable swivelling with respect to a body of the head between an extended position and a retracted position, the anchorage being fixed to the body, and a spring is fixed on the one hand to the body and on the other hand to the cam to be able to bias the cam away from the extended position It is a further object of the invention to provide a method for manufacturing a camming clamping device that is easier to perform than the methods of the prior art.

This result tends to be achieved by means of a method for manufacturing comprising the following steps:

providing a head sub-assembly including a head provided with at least one cam designed to wedge in a crevice;

providing a rod sub-assembly having a rod and at least one wire element, the rod being hollow and passed through by the at least one wire element, the rod sub-assembly delineating a through hole designed to receive a connector to form an attachment point, the at least one wire element delineating the through hole, the wire element defining at least one loop, the at least one loop being passed through by a tube;

fixing an anchorage to the head, the anchorage passing through the tube and the at least one loop to attach the at least one loop to the head sub-assembly and to constitute a mechanical continuity between the head and the attachment point.

It is a further object of the invention to provide a method for replacing a wire element of a camming clamping device that is easier to perform than in the configurations of the prior art.

This result tends to be achieved by means of a method for replacing comprising the following steps:

providing a camming clamping device according to any one of the foregoing configurations;

removing the anchorage and separating the rod sub-assembly from the head sub-assembly;

providing a new rod sub-assembly having a rod and at least one wire element, the rod being hollow and being passed through by the at least one wire element, the rod sub-assembly delineating a through hole designed to receive a connector to form an attachment point, the at least one wire element delineating the through hole, the wire element defining at least one loop attached to the head sub-assembly to constitute a mechanical continuity between the head and the attachment point, the at least one loop being passed through by a tube;

fixing the rod sub-assembly with the head sub-assembly by means of an anchorage fixed to the head and passing through the tube and the at least one loop to constitute the mechanical continuity between the head and the attachment point.

BRIEF DESCRIPTION OF THE DRAWINGS

Other advantages and features will become more clearly apparent from the following description of particular embodiments and implementation modes of the invention given for non-restrictive example purposes only and represented in the appended drawings, in which.

DESCRIPTION OF THE EMBODIMENTS

Figure 1:
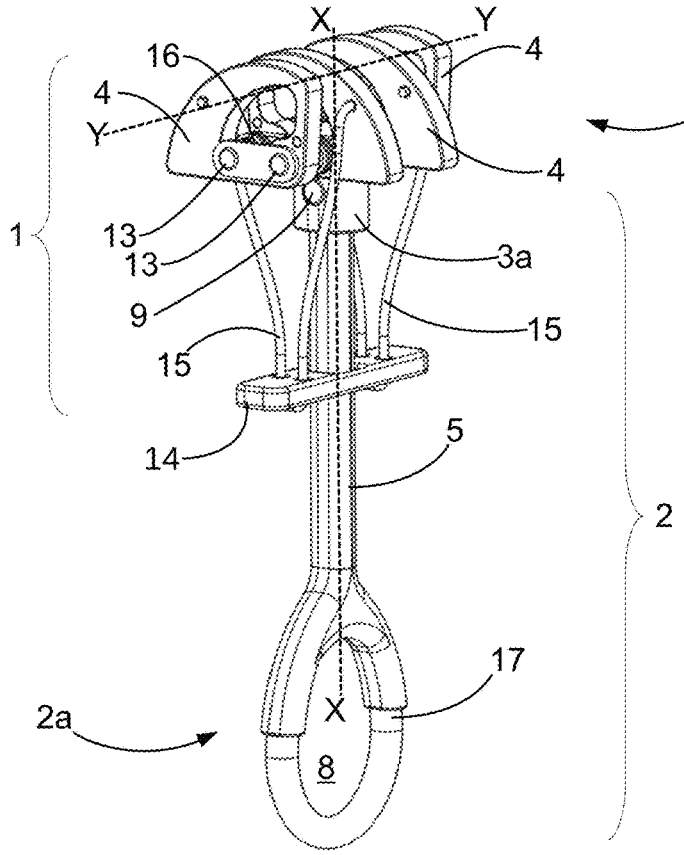
FIG. 1 schematically illustrates a perspective view of a camming clamping device.
Figure 2:
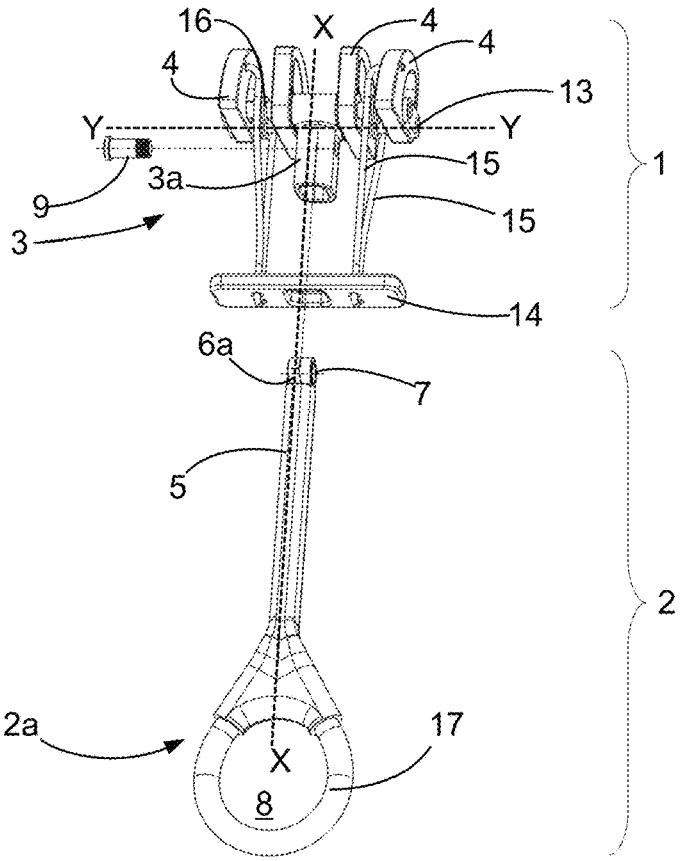
FIG. 2 schematically illustrates an exploded perspective view of a camming clamping device according to a first embodiment.
Figure 3:
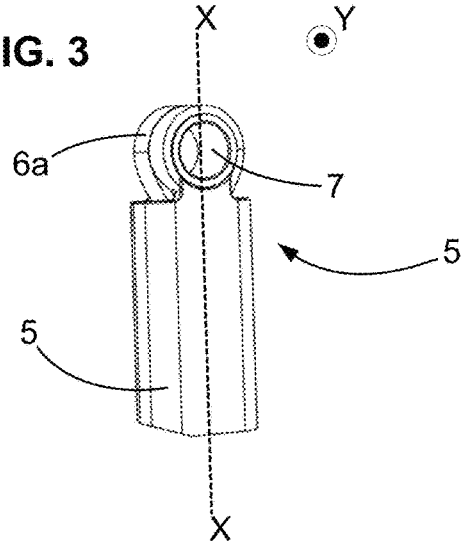
FIG. 3 schematically illustrates a perspective view of the top end of the rod with a tube of the camming clamping device according to the first embodiment.
Figure 4:
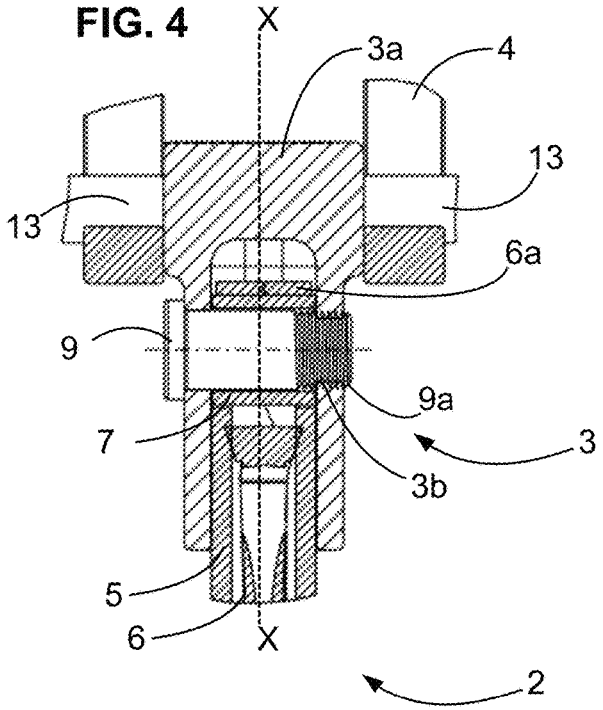
FIG. 4 schematically illustrates a sectional view of the connection between the head sub-assembly and the rod sub-assembly of the camming clamping device according to the first embodiment.
Figure 5:
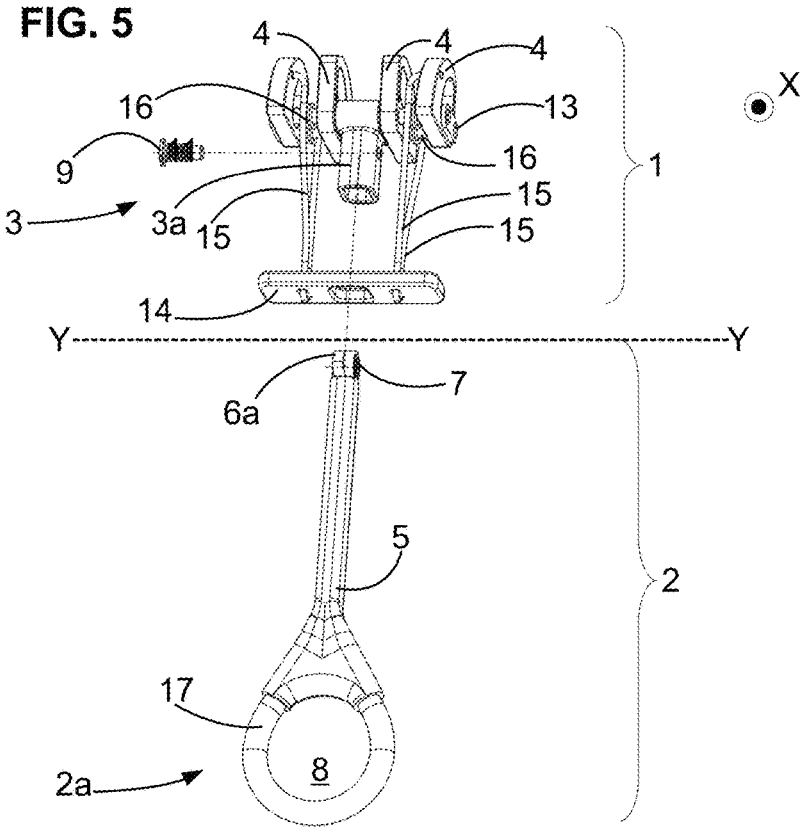
FIG. 5 schematically illustrates an exploded perspective view of a camming clamping device according to a second embodiment.
Figure 6:
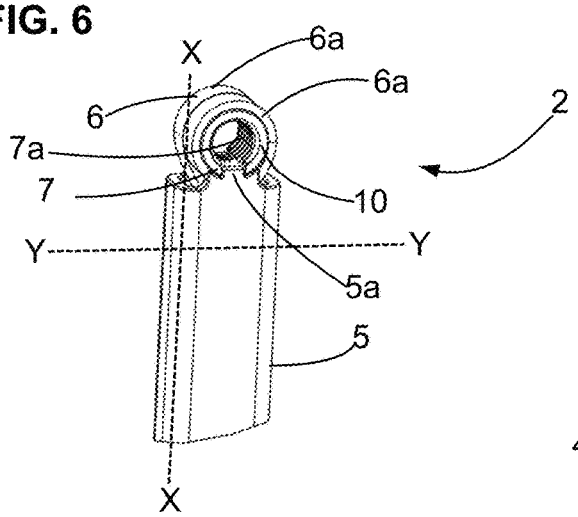
FIG. 6 schematically illustrates a perspective view of the top end of the rod with a tube of the camming clamping device according to the second embodiment.
Figure 7:
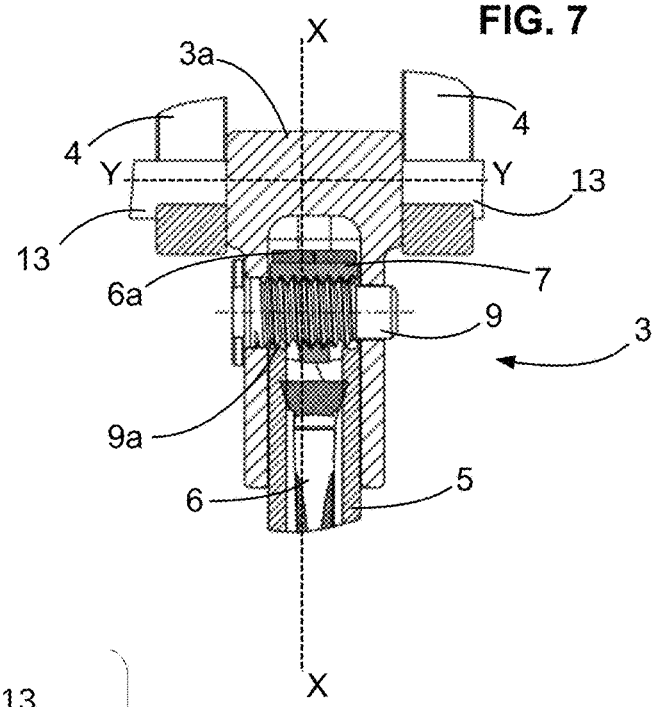
FIG. 7 schematically illustrates a sectional view of the connection between the head sub-assembly and the rod sub-assembly of the camming clamping device according to the second embodiment.

FIGS. 1 to 13 illustrate different embodiments of a camming clamping device also referred to as "camming clamp". The camming clamping device is preferentially an active clamping device.

The camming clamping device comprises a head sub-assembly 1 and a rod sub-assembly 2. The head sub-assembly 1 is located at a first end and comprises a head 3 and at least one cam 4. The head sub-assembly 1 is designed to wedge in a crevice.

The rod sub-assembly 2 has a rod 5, a wire element 6 and a tube 7. The rod 5 is hollow and is passed through by the wire element 6. The rod sub-assembly 2 defines an annular end 2*a* that has a through hole 8. The wire element 6 delineates the through hole 8. In other words, the wire element 6 surrounds the through hole 8 either alone or in combination with its attachment point or points with the head 3. Once the wire element 6 has been attached to the head 3, the wire element 6 constitutes the mechanical continuity between the head 3 and the opposite end of the chock represented by the through hole 8 designed to form an attachment point, i.e. designed to receive a connector. The rod 5 extends mainly in a first direction XX that corresponds to the longitudinal direction of the rod 5, i.e. its largest dimension. The rod 5 has a top end designed to be fixed to the head 3 and a bottom end designed to define an annular end 2*a* defining the through hole 8. The bottom end and the top end are opposite one another in the XX direction.

The attachment between the wire element 6 and the head 3 facilitates separation of the head sub-assembly 1 and the rod sub-assembly 2 to make replacement of the wire element 6, and in more general manner of at least one of the components of the rod sub-assembly 2, easier to perform.

The wire element 6 defines at least one loop 6*a* and the tube 7 passes through the at least one loop 6*a*. The tube 7 and the at least one loop 6*a* are passed through by an anchorage 9 that is fixed to the head 3. The anchorage 9 constitutes the mechanical connection between the wire element 6 and the head 3. To facilitate total or partial replacement of the rod sub-assembly 2, it is important to facilitate installation of the wire element 6 in the head 3.

The tube 7 prevents the loop 6*a* from closing thereby facilitating installation of the anchorage 9 in the loop 6*a* to constitute the mechanical continuity between the head 3 and the rod sub-assembly 2. The tube 7 forces the loop 6*a* to define a minimum cross-section that is substantially equal to or larger than the cross-section of the anchorage 9. When the loop 6*a* is installed in the head 3, the loop 6*a* rubs against the head 3 and can deform, but it keeps an opening that is equal to or larger than the cross-section of the anchorage 9 to allow the anchorage 9 to be attached to the head 3 and to the wire element 6 through the tube 7.

In a preferential embodiment illustrated in FIGS. 2 to 13, the tube 7 is arranged at least partially salient from the rod 5 and sufficiently salient for the cross-section of the inner hole of the tube 7 to be able to receive the anchorage 9. The tube 7 enables the wire element 6 and the anchorage 9 to be separated thereby enabling the mechanical integrity of the wire element 6 as regards the surface of the anchorage 9 to be protected. In an alternative embodiment, the tube 7 is arranged in the rod 5 and the rod 5 has at least one hole that is facing the tube 7 in the direction of insertion of the anchorage 9. The hole in the rod 5 allows the anchorage 9 to pass through the rod 5, the loop 6*a* and the tube 7. Preferentially, the rod 5 defines two holes arranged facing one another that enable the anchorage 9 to pass through the tube 7 and the rod 5 and fixed to the head 3 at two points.

Advantageously, the head 3 has a body 3*a* defining a cavity receiving a top end of the rod 5. The tube 7 is completely hidden by the body 3*a* in a direction perpendicular to the direction of insertion of the top end in the cavity.

In preferential manner, the position of the tube 7 with respect to the top end of the rod 5 is stationary in the XX direction.

The head 3 defines a cavity, for example a blind cavity, that is designed to receive the rod 5, the tube 7 and the loop 6*a*. In order to preserve an acceptable compactness, the cavity has a reduced cross-section and preferably a cross-section that is complementary to the cross-section of the rod 5 perpendicularly to the first direction XX.

In preferential manner, the tube 7 has a width that is equal to or larger than the width of the rod 5, as illustrated in FIGS. 2 to 13. By using a tube 7 that is at least as wide as the rod 5, it is easier to force on the rod 5 to insert the tube 7 to the required position in the XX direction. The tube 7 comes up against the stop formed by the rod 5, and the rod 5 is used to insert the tube 7 facing the insertion hole of the anchorage 9. As an alternative, the cross-section of the assembly formed by the tube 7 and the loop 6*a* is larger than the inner cross-section of the rod 5.

In particularly advantageous manner, the wire element 6 is completely hidden inside the rod 5 with the exception of the loop 6*a* or the loops 6*a* that are salient on one side of the head of the rod 5. The part of the head of the rod 5 is designed to be inserted in the head 3.

In a particular embodiment, the anchorage 9 is installed removable with respect to the head 3. For example, the anchorage 9 is a screw, a bolt or any other element that can be installed on the head 3 and removed several times. Such a configuration enables the rod sub-assembly 2 and the head sub-assembly 1 to be separated easily.

In an alternative embodiment, the anchorage 9 is installed destructible independently with respect to the head 3. The anchorage 9 can be destroyed with respect to the head 3 without destroying the head 3. Such a configuration enables several rod sub-assemblies 2 to be successively installed on the same head sub-assembly 1 replacing the anchorage 9 by a new anchorage 9. Destruction of the anchorage 9 enables the rod sub-assembly 2 to be replaced and incites the user to install a kit comprising a new anchorage 9 and a new wire element 6. The anchorage 9 can be an insert that is crimped, stuck, welded, brazed or fixed by any other irremovable fixing means.

In the previous embodiments, the tube 7 is preferentially divisible and is installed fixedly in the head 3. Extraction of the tube 7 from the head 3 and/or removal of the anchorage 9 results in destruction of the tube 7.

In preferential manner, when the anchorage 9 is fixed to the head 3, the tube 7 is fixed in irremovable manner with respect to the anchorage 9. Disassembly or destruction of the anchorage 9 destroys the tube 7. This has the effect of preventing reuse of the tube 7 or of making reuse thereof more difficult. It is then possible to detect a wire element 6 that has already been used as it has already been installed. For example, the anchorage 9 has a cross-section that is slightly larger than the cross-section of the through hole 8 of the tube 7. As the anchorage 9 is progressively inserted in the tube 7, the tube 7 breaks preventing the tube 7 from being reused. As an alternative, once the anchorage 9 has been fixed to the head 3, a portion of the anchorage 9 is fixed to the tube 7. The fixing between the anchorage 9 and the tube 7 is one-way. When the anchorage 9 is sought to be removed, the tube 7 is destroyed. It is further possible to have an anchorage 9 that grinds a part of the thickness of the tube 7. Insertion of the anchorage 9 reduces the thickness of the tube 7, weakening the tube 7 that is no longer able to prevent deformation of the strap and makes a subsequent insertion of the anchorage 9 complicated.

In a particular embodiment, the wire element 6 is subjected to a tensile stress in the longitudinal direction XX of the wire element 6 between the head 3 and the through hole 8. The rod 5 acts as end-of-travel stop on the tube 7. The rod 5 prevents the tube 7 from moving towards the through hole 8 beyond a threshold position. The wire element 6 is under tension which enables the position of the strap to be fixed with respect to the tube 7. Installation of the wire element 6 under tension ensures a good resistance of the rod sub-assembly 2 over time before the latter is attached with the head sub-assembly 1. A rod 5 of adjustable length can be used to apply a tensile stress.

In a preferential embodiment, the wire element 6 has several loops 6*a*. Each of the loops 6*a* is attached to the head 3. In advantageous manner, the loops 6*a* are installed facing one another and are passed through by a tube 7 and one and the same anchorage 9.

In a particular embodiment, the anchorage 9 is a screw. In the configuration illustrated in FIGS. 2 to 4, a thread 9*a* of the screw is inserted in a thread 3*b* of the head 3. The anchorage 9 presses on the head 3 on each side of the rod 5. In the configuration illustrated in FIGS. 5 to 7, a thread 7*a* of the tube 7 is inserted in the thread 9*a* of the screw. The anchorage 9 presses on the head 3 on each side of the rod 5. It is advantageous to block rotation of the tube 7 around the insertion axis of the anchorage 9 in the tube 7. A rotation blocker is used that is formed partly by the tube 7 and partly by the rod 5 and/or the head 3. In one specific case, the rod 5 forms a pin 5*a* that is inserted in a hole of the tube 7 to prevent rotation. In an alternative, the external shape of the tube 7 is non-circular. The rod 5 and/or the head 3 present a complementary shape to that of the tube 7 thereby preventing rotation of the tube 7.

Figure 8:
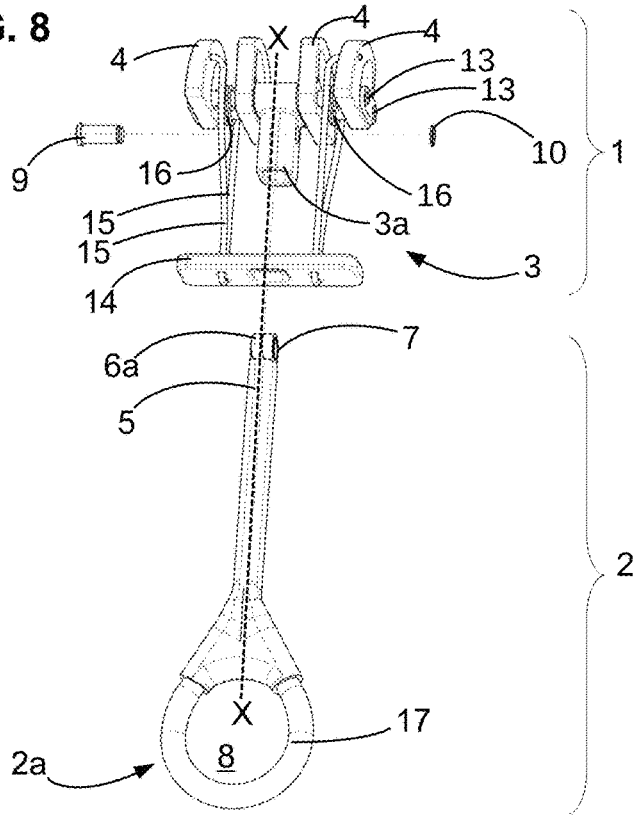
FIG. 8 schematically illustrates an exploded perspective view of a camming clamping device according to a third embodiment.
Figure 9:
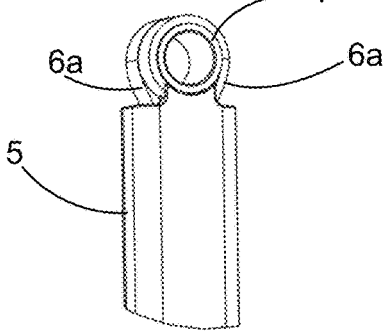
FIG. 9 schematically illustrates a perspective view of the top end of the rod with a tube of the camming clamping device according to the third embodiment.
Figure 10:
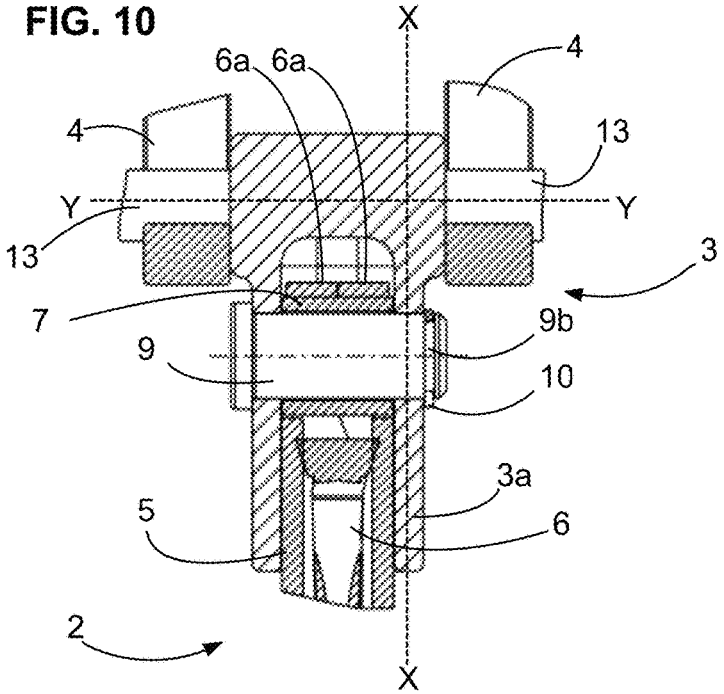
FIG. 10 schematically illustrates a sectional view of the connection between the head sub-assembly and the rod sub-assembly of the camming clamping device according to the third embodiment.

In the configuration illustrated in FIGS. 8 to 10, the anchorage 9 defines a groove 9*b*. The anchorage 9 passes through the tube 7 and through the loop 6*a* or the loops 6*a*. The end of the anchorage 9 defining the groove 9*b* passes through the head 3 and the tube 7. A clip 10 is inserted in the groove 9*b* to block the anchorage 9 with the head 3 and prevent removal thereof. The anchorage 9 presses on the head 3 on each side of the rod 5. The clip 10 has to be removed to remove the anchorage 9. Removal of the clip 10 preferably corresponds to breaking of the clip 10.

Figure 11:
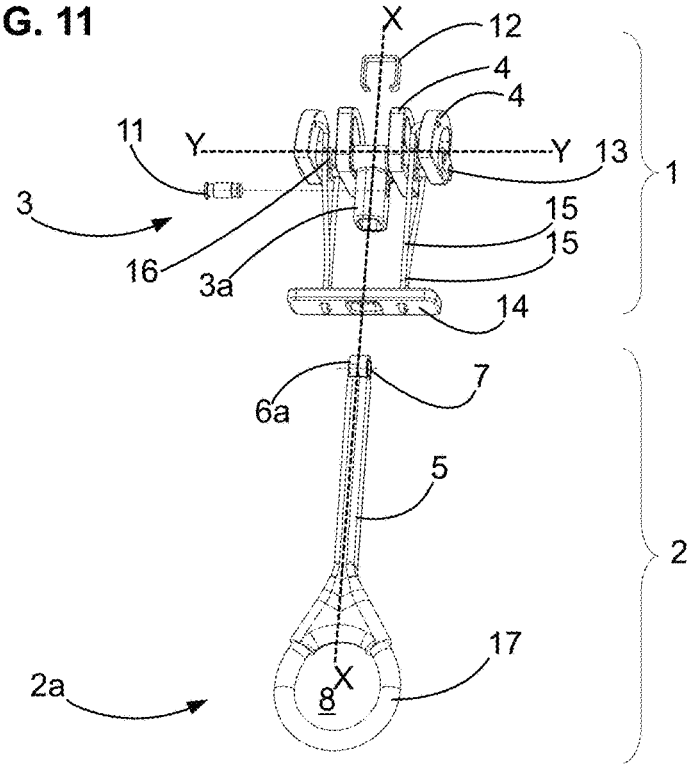
FIG. 11 schematically illustrates an exploded perspective view of a camming clamping device according to a fourth embodiment.
Figure 12:
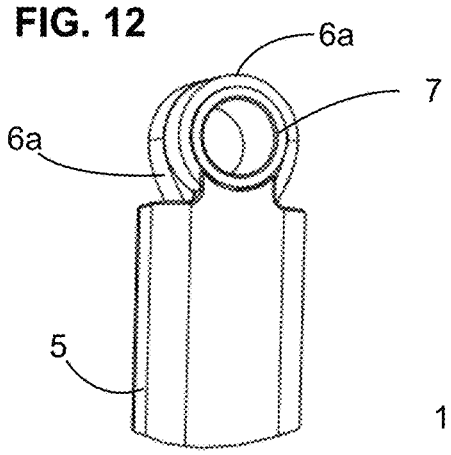
FIG. 12 schematically illustrates a perspective view of the top end of the rod with a tube of the camming clamping device according to the fourth embodiment.
Figure 13:
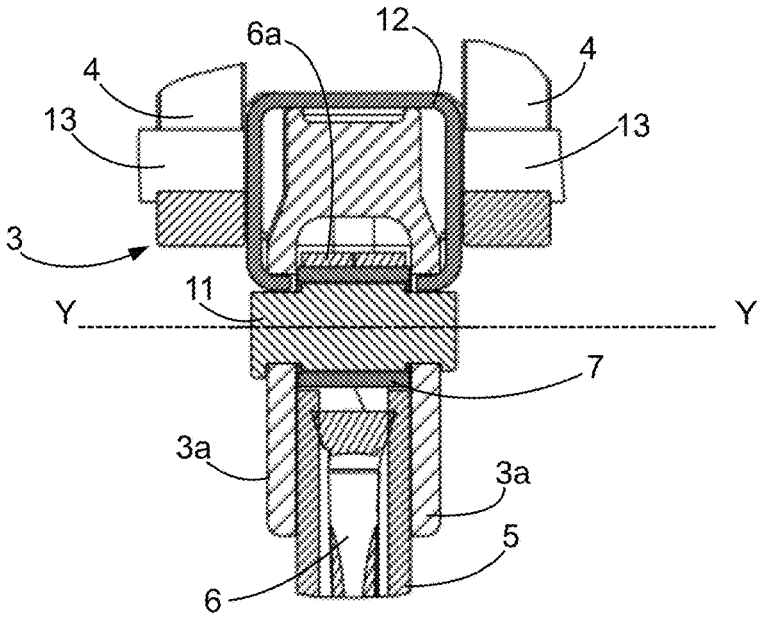
FIG. 13 schematically illustrates a sectional view of the connection between the head sub-assembly and the rod sub-assembly of the camming clamping device according to the fourth embodiment.

In the embodiment illustrated in FIGS. 11 to 13, the anchorage 9 has a shaft 11 and a clamp 12. The head 3 defines one or two holes that present a first cross-section that is larger than the cross-section of the shaft 11. This enables the shaft 11 to be inserted in the head 3. Once the shaft 11 has been inserted in the head 3, a clamp 12 is fixed to the head 3 reducing the value of the cross-section to a value of a second cross-section that is smaller than the cross-section of the shaft 11. The shaft is blocked in the head 3. In the uninstalled position of the clamp 12, the hole or holes designed to receive the shaft 11 present a first value that is greater than the cross-section of the shaft 11. In the installed position of the clamp 12, the hole or holes designed to receive the shaft 11 present a second value that is lower than the cross-section of the shaft 11. Depending on the configurations, the clamp 12 can be installed either removable or irremovable. Preferentially, in the installed position, the clamp 12 is irremovable from the head 3 without resulting in the clamp 12 being broken. The shaft 11 presses on the head 3.

In a preferred embodiment, the camming clamping device is an active clamping device as illustrated in FIGS. 1 to 13.

The head sub-assembly 1 forms a first end that is a head 3. The rod sub-assembly 2 forms the opposite end to the head end and defines an annular end 2*a*. The head 3 has at least one cam 4 and preferably several cams 4 that are installed movable swivelling between an extended position and a retracted position. The cam or cams 4 are installed movable around at least one pivot shaft 13 of the head 3. The cam or cams 4 are mechanically coupled to a body 3*a* of the head 3. The pivot shaft 13 is fixed to the body 3*a* of the head 3. The body 3*a* can be formed by one or more parts. The at least one cam 4 is installed swivelling with respect to the body 3*a*. The pivot shaft 13 extends mainly in a second direction YY that is perpendicular or substantially perpendicular to the first direction XX.

In conventional manner, the annular end 2*a* is in the form of a ring that defines a through hole 8 configured to receive a carabiner. The annular end 2*a* is able to support the weight of a user.

The camming clamping device has a wire element 6 that connects the head 3 mechanically with the annular end 2*a*. The wire element 6 extends continuously from the head 3 up to the annular end 2*a* in a first direction XX. The wire element 6 is attached to the head 3 at each of its ends and extends along the annular end 2*a* between its attachment points with the head 3. The wire element 6 constitutes the mechanical continuity between the head 3 and the annular end 2*a*. The wire element 6 couples the cams 4 mechanically to the annular end 2*a* so that a user attached to the annular end 2*a* is securedly held by means of the cams 4 wedged for example in a crack.

The clamping device comprises an actuating system coupled to the at least one cam 4. The actuating system is configured to selectively engage the retracted position of the at least one cam 4. The actuating system has a trigger 14 installed able to slide along the first direction XX connecting the head 3 and the annular end 2*a*.

In other words, the trigger 14 is installed movable with respect to the head 3 and is coupled to the at least one cam 4. When the trigger 14 is outside the first position, the at least one cam 4 is outside the extended position.

Preferentially, the trigger 14 is coupled to the at least one cam 4 so that movement of the trigger 14 away from the head 3 results in a movement of the at least one cam 4 away from the extended position, i.e. to the retracted position. In preferential manner, the trigger 14 is coupled to all the cams 4 so that movement of the trigger 14 away from the head 3 results in movement of cams 4 to the retracted position.

It is advantageous for movement of the trigger 14 in the direction of the head 3 not to impose any movement of the cam 4 and in particular not to impose movement of the cam 4 to the extended position.

In a preferential embodiment, the trigger 14 is installed able to slide along the wire element 6 between the head 3 and the annular end 2*a*. The trigger 14 can be coupled to the cam 4 or to each cam 4 by an additional wire element 15. The additional wire element 15 can be a metal cable, a textile element or a wire element made from synthetic material, for example from plastic. The additional wire element 15 couples the cam 4 to the trigger 14 and enables a movement of the trigger 14 towards the annular end 2*a* to be translated into a movement of the cam 4 to the retracted position.

The camming clamping device has a spring 16 that is configured to bias the at least one cam 4 to the extended position. The spring 16 can be manufactured in any technology: it can be a coil spring operating in traction, in compression, in torsion or in flexion. It can also be a blade or a metal wire that is elastically deformed. In the absence of stress and obstacles, the spring 16 places the cam or cams 4 in the extended position. The force applied on the trigger 14 to move away from the head 3 corresponds to a force applied on the spring 16 to move the cam or cams 4 to the retracted position. In one embodiment, the spring 16 is fixed on the one hand to the cam 4 and on the other hand to the head 3. In another embodiment, the spring 16 is fixed on the one hand to a first cam 4 and on the other hand to a second cam 4 installed on another pivot shaft 13 than that of first cam 4. The clamping device can comprise as many springs 16 as cams 4 or as many springs 16 as pairs of cams 4.

In preferential manner, the camming clamping device comprises at least one rod 5 that extends from the head 3 in the direction of the annular end 2*a*, i.e. in the first direction XX. In the embodiments illustrated in FIGS. 1 to 13, the camming clamping device comprises a single the rod 5 that extends longitudinally in the first direction XX. In preferential manner, the rod 5 is up against the stop formed by the head 3 or is fixed to the head 3. Advantageously, the rod 5 at least partially defines the through hole 8 of the annular end 2*a*.

The rod 5 is hollow and is passed through by the wire element 6 to connect the annular end 2*a* with the head 3. In preferential manner, the rod 5 is more rigid than the wire element 6 perpendicularly to the XX direction thereby enabling the camming clamping device to be held by means of the rod 5 and the clamping device to be placed precisely in a crack in comparison with an equivalent device without the rod 5. In preferential manner, the rod 5 extends continuously from the head 3 up to the annular end 2*a* so as to provide a good mechanical strength when the clamping device is secured by the annular end 2*a* and the trigger 14. It is advantageous for the trigger 14 to be installed able to slide along the rod 5 and for the rod 5 to separate the wire element 6 and the trigger 14. The rod 5 enables the wire element 6 to be protected outside the head 3 up to the annular end 2*a*.

Figure 14:
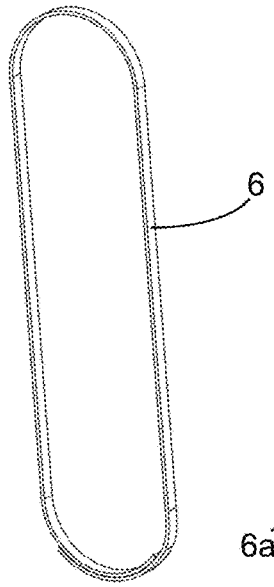
FIG. 14 schematically illustrates a perspective view of a wire element ring designed to connect the head and the annular end of the camming clamping device before folding is performed.

As illustrated in FIG. 14, the wire element 6 is in the form of a ring, preferably a ring made from textile material. The ring is formed by a strand a first end of which is fixed to an opposite second end. It is advantageous for the ring to be closed by a stitched seam. The two ends of the wire element 6 are fixedly secured on one another by a stitched area. Stitching is a well-mastered process that enables a ring with an efficiently controlled tensile strength to be easily obtained. The use of a stitching step enables a ring to be formed that is less costly and that presents a dimension that is better controlled than its equivalent obtained by splicing. It is advantageous for the ring to be devoid of crimping and splicing. The wire element 6 can be a strap or a rope.

The ring made from textile material can be a ring made of polyethylene of very high molar mass, for example made from a material marketed under the tradenames Dyneema® or Spectra®.

FIG. 14 illustrates a wire element 6 in the form of a ring. The ring is folded to define at least two legs 6*b* each comprising a top end and a bottom end. Each leg 6*b* comprises two strands. The two strands join up in the top end to form a loop 6*a*. The loop 6*a* is designed to be attached to the head 3. The bottom end of each leg 6*b* is extended by a connecting portion 6*c*. The connecting portion 6*c* connects the legs 6*b* to one another. The connecting portion 6*c* delineates the through hole 8 of the annular end 2*a*.

The strands of each leg 6*b* are extended on one side or the other to form a loop 6*a* or a connecting portion 6*c*. A loop 6*a* extends a strand by another strand of the same leg 6*b*. The connecting portion 6*c* extends a strand by a strand of another leg 6*b*. In other words, each strand connects one end of a loop 6*a* with the connecting portion 6*c*. The connecting portion 6*c* comprises at least four strands of the wire element 6. The connecting portion 6*c* comprises twice as many strands as the loops 6*a*. Preferentially, each strand of the connecting portion 6*c* is installed able to slide with respect to the others.

Figure 15:
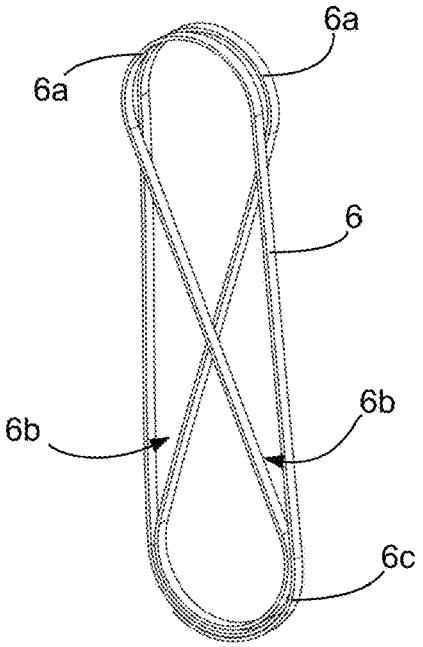
FIG. 15 schematically illustrates a perspective view of a wire element ring folded in such a way that two pairs of strands are designed to connect the head ring and the annular end of the camming clamping device.

FIG. 15 illustrates the wire element 6 folded in such a way as to define a U-shape with two legs 6*b* connected by a connecting portion 6*c*. The two legs 6*b* are terminated by a loop 6*a* at the end opposite the connecting portion 6*c*. The two legs 6*b* are deformed so that the loops 6*a* come to face one another to define a through hole 8.

As illustrated in FIGS. 3, 4, 7, 8, 11 and 12, the wire element 6 is in the form of a ring that is folded and shaped to form a U. The two legs 6*b* are close to one another whereas the connecting portion 6*c* defines a ring with a through hole 8 to define the annular end 2*a* of the clamping device. When the loops 6*a* are attached to an anchorage 9, application of a force on the connecting portion 6*c* has the effect of stressing the multiple strands that connect the connecting portion 6*c* and the anchorages 9. The wire element 6 provides the tensile strength.

The loops 6*a* are fixed to the head 3 and the connecting portion 6*c* delineates the through hole 8 of the annular end 2*a*. The strands of the wire element 6 constitute the mechanical continuity between the head 3 and the annular end 2*a*. This embodiment is particularly advantageous as attachment of the head 3 with the wire element 6 is performed using the loops 6*a*. There is no need to fix the wire element 6 to the head 3 with a knot, a splicing, stitching, crimping or any other technological step modifying the mechanical integrity of the wire element 6.

The wire element 6 at least partially delineates the through hole 8 of the annular end 2*a* by means of the connecting portion 6*c* thereby obviating the need to form a specific loop 6*a* by means of a knot, a splicing, stitching, crimping or any other technological step modifying the mechanical integrity of the wire element 6.

The wire element 6 has at least two loops 6*a* attached to the head 3, i.e. attached directly to the head 3, and that are connected by at least two strands that extend continuously along the rod 5 and delineate the through hole 8 of the annular end 2*a*. The wire element 6 that is annular constitutes the mechanical continuity of the clamping device. This technical solution is more advantageous than the one presented in the document U.S. Pat. No. 10,143,892 that uses a splicing step to form two loops 6*a* respectively designed for attaching the head 3 and for defining the through hole 8 of the annular end 2*a*.

Figure 16:
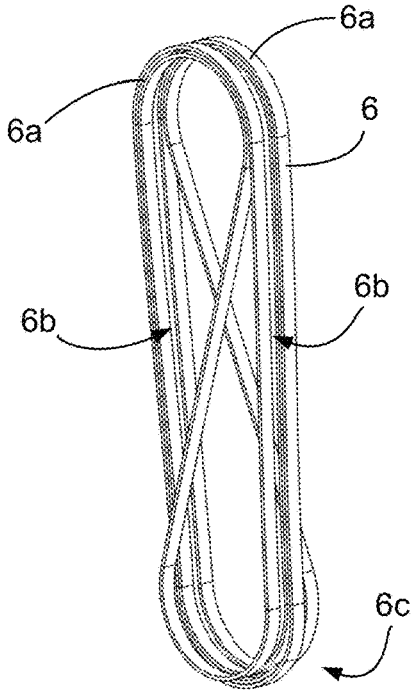
FIG. 16 schematically illustrates a perspective view of a wire element ring folded in such a way that four pairs of two strands are designed to connect the head and the annular end of the camming clamping device.

FIG. 16 illustrates another type of folding of the wire element 6 into the form of a ring. The head 3 and the annular end 2*a* are connected by more than four strands of the wire element 6. In the illustrated configuration, the head 3 and the annular end 2*a* are connected by eight strands. The wire element 6 defines four legs 6*b* formed by two strands and therefore one loop 6*a* each. Other arrangements are possible.

To provide a good strength, the ring is preferentially devoid of knots in the legs 6*b* and/or in the head 3. The loops 6*a* are extended at their ends by strands that come from or extend up to the annular end 2*a* and not by a knot formed at the end of the wire element 6.

FIGS. 3, 4, 7, 8, 11, 12 and 15 illustrate a ring that is folded once to form four strands of the wire element 6 that connect the annular end 2*a* and the head 3. Different types of folding are usable for the ring formed by the wire element 6 to define a connecting portion 6*c* able to at least partially delineate the annular end 2*a* and to extend at least two legs 6*b* designed to extend up to the head 3 and terminated by the loops 6*a* to be attached to the head 3.

The rod 5 is passed through by at least four strands of the wire element 6 between the head 3 and the annular end 2*a*. The four strands are in mechanical continuity by means of the connecting portion 6*c* and the loops 6*a*. The connecting portion 6*c* constitutes the mechanical continuity between the legs 6*b*. Preferentially, the seam is located in the connecting portion 6*c* to limit the space occupation in the head 3 or close to the head 3.

Each loop 6*a* present in the head 3 is fixed to the head 3. Preferably, each attachment point between a loop 6*a* and the head 3 allows the wire element 6 to slide with respect to the head 3. When the wire element 6 is placed under tension, the tensile stress balance out between the strands due to sliding of the loops 6*a*. Preferably, the connecting portion 6*c* allows the different strands to slide with respect to one another to facilitate balancing of the forces.

Application of a tensile stress between the head 3 and the annular end 2*a* has the effect of stressing the wire element 6 and in particular the at least four strands of the wire element 6 that connect the head 3 to the annular end 2*a*. Increasing the number of strands enables a better trade-off to be achieved between the tensile strength in the XX direction, the space occupation inside the rod 5 and the flexibility perpendicularly to the XX direction.

The document US 2004/0035992 uses a loop 6*a* made of a strap that is installed flexible in a hollow rod. The maximum length of the loop 6*a* corresponds substantially to half the length of the strap. When the loop 6*a* is manufactured, a discrepancy exists on the cut length of the strap and on the length/position of the seam with respect to the required value. When several loops 6*a* are made, this results in a dispersion of the length of the loop 6*a* around of a target value. Pending use, the camming clamping device is hung by the strap. This results in the deviations regarding the length of the loop 6*a* leading to the camming clamping device not being as identical and interchangeable as expected, which can complicate extraction of the camming clamping device. The use of a wire element folded to form a U-shape has the effect of dividing at least by two the final result of the manufacturing uncertainty on the final length between attachment point 9 with the head 3 and the annular end.

Document U.S. Pat. No. 10,143,892 uses a single ring made from textile material formed by splicing. There again, in comparison with the prior art, the use of a wire element folded to form a U-shape has the effect of dividing by two the final result of the manufacturing uncertainty on the final length between attachment point 9 with the head 3 and the annular end 2*a*. It is also important to recall that the splicing step is long and costly in comparison with securing by a single seam where the two strands are arranged on one another and not in one another, i.e. without splicing.

In FIGS. 2, 5, 8 and 11, the legs 6*b* are deformed by an angle equal to 90° so that the through hole 8 defined by the loops 6*a* is offset by 90° with respect to the through hole 8 defined by the connecting portion 6*c*. The offset angle can be represented by the angle that exists between the median cutting planes enabling a ring to be observed. The angular offset corresponds to a pivoting around the XX axis.

Different embodiments are possible to attach the loops 6*a* of the wire element 6 with the head 3.

In a particular embodiment, the head 3 has at least one anchorage 9, for example an anchorage shaft. The loops 6*a* are attached to the at least one anchorage 9 to constitute the mechanical continuity between the head 3 and the wire element 6. Preferentially, the wire element 6 passes round the anchorage 9 to constitute the mechanical continuity with the annular end 2*a*. More preferentially, the loop 6*a* throttles the anchorage 9 to constitute the mechanical continuity.

In the embodiments illustrated in FIGS. 1 to 13, different configurations of attachment of the wire element 6 to the head 3 are illustrated.

FIGS. 2 to 13 illustrate embodiments where the loops 6*a* extending the legs 6*b* form two offset parallel planes. The loops 6*a* are installed facing one another in a direction perpendicular to the parallel planes to form a through hole 8. An anchorage 9 of the head 3 passes through the loops 6*a* to secure the wire element 6 with the head 3. A configuration with two loops 6*a* or more than two loops 6*a* is possible.

FIGS. 2 to 13 illustrate an embodiment in which the loops 6*a* present at the ends of the legs 6*b* of the ring are arranged facing one another in a direction perpendicular to the first direction XX. An anchorage shaft passes through the two loops 6*a* in the direction perpendicular to the first direction XX. The anchorage shaft is fixed to a body 1*a*. The anchorage shaft is different from pivot shaft or shafts 13 of the at least one cam 4.

It is particularly advantageous to have an anchorage 9 installed removable with respect to the head 3 so as to have a wire element 6 that is easily replaceable. Removal of the anchorage 9 eliminates the attachment between the wire element 6 and the head 3 thereby enabling the wire element 6 to be replaced.

It is advantageous for the anchorage 9 to be an anchorage shaft, i.e. a rod 5 that is inserted in the body 1*a* to secure the loops 6*a*. The anchorage shaft advantageously has a circular cross-section and advantageously a smooth surface.

For example, the anchorage shaft is fixed to the body 1*a* of the head 3 by screw-fastening, crimping, or riveting. The anchorage shaft extends mainly in a direction perpendicular to the first direction XX.

To replace the wire element 6, the anchorage 9 is disassembled, and a pull is exerted on the wire element 6 in the first direction XX. According to the particular case, the rod 5 is kept or the rod 5 is replaced. A new wire element 6 is installed with the loops 6*a* that are inserted in the head 3. The anchorage 9 or a new anchorage 9 passes through the loops 6*a* and is fixed to the head 3 to attach the wire element 6 with the head 3. Replacement of the wire element 6 is easy and does not require any operation on cams 4, the pivot shaft or shafts 13 or on the trigger 14.

In a particular embodiment, the rod 5 has an adjustable length in the XX direction. Adjustment of the length enables an increased length of the wire element 6 with respect to the rod 5 to be provided in the assembly phase. Once the loops 6*a* have been attached to the head 3, the length of the rod 5 is increased to absorb the excess wire element 6. This provides a better ergonomy between the head 3 and the annular end 2*a* without modifying the tensile strength between the head 3 and the annular end 2*a*.

The rod 5 with adjustable length can be a telescopic rod. Other embodiments are however possible.

In preferential manner, the annular end 2*a* is provided with a stiffener 17 that at least partly defines the shape of the annular end 2*a*. The stiffener 17 defines a shape that is or is close to that of a ring. The stiffener 17 is hollow. The stiffener 17 is passed through by the wire element 6 which defines the connecting portion 6*c* of the 'U'. It is advantageous for the stiffener 17 to form the stop that comes into contact with the rod 5 and prevents the rod 5 from moving away from the head 3 beyond a threshold value. The material forming the stiffener 17 and the shape of the stiffener 17 define the relationship between the deformation of the stiffener 17 and the value of the compressive stress applied on the rod 5.

The embodiment illustrated in the figures makes disassembly easy in order to change at least one of the following components: the wire element 6, the rod 5 or the stiffener 17. In an advantageous embodiment, the rod 5 is disassemblable with respect to the head 3 which enables the rod 5 to be replaced when the latter is damaged. It is also possible to replace the stiffener 17 easily when the latter is damaged.

It is further possible to replace the rod 5 and the wire element 6 in order to adjust the length of the clamping device to a specific need. An extender of the trigger 14 can then be envisaged if the length of the rod 5 and of the wire element 6 is increased considerably.

The rod 5 is coupled mechanically to the head 3. The stiffener 17 is coupled to the rod 5. It is advantageous for the rod 5 to allow a part of the stiffener 17 to be inserted. It is advantageous for the stiffener 17 to surround the wire element 6 continuously from a first end that comes up against the stop formed by the rod 5 up to a second end that comes up against the stop formed by the rod 5. The wire element 6 is completely protected in the salient portion of the rod 5 that defines the annular end 2*a*.

In a particular embodiment, the rod 5 has a tapered end facilitating formation of a ring of considerable size in the annular end 2*a*.

The rod 5 is preferentially made from polymer material so as to be able to be flexible in one or more directions perpendicular to the first direction XX.

In the illustrated embodiments, the camming clamping device presents four cams 4. It is possible to use more or less cams 4. The configurations illustrated for installation of the wire element 6 are applicable on clamping devices that comprise one, two, three, four or more cams 4. The number of cams 4 can be even or odd. The cams 4 are preferentially made from metallic material, for example from aluminium alloy or from steel.

The embodiments illustrated in FIGS. 1 to 13 are particularly advantageous as they enable the wire element 6 constituting the mechanical continuity between the head 3 and the annular end 2*a* to be replaced without having to dismantle the assembly formed by the body 1*a*, the pivot shafts 13 and the cams 4. This makes for enhanced safety by preventing incorrect reassembly of the head 3. In addition, the ring formed by the wire element 6 is manufactured in plant with well-mastered stitching methods thereby ensuring a good mechanical strength of the wire element 6.

The document US 2004/0035992 discloses a camming chock that is provided with a single strap ring. The ring is passed through by the pivot shaft of the cams and extends through the hollow rod to open onto the other side of the rod. The strap ring is installed without tension so that the strap end can exit at the level of the head 3 and be damaged. To place the chock in a crack, the rod has to be held placing the index finger and middle finger on the two ends of the trigger and installing the thumb against the end of the rod opposite the head 3. As the strap is installed free, it is to be expected that the thumb will press the two thicknesses of strap against the end of the rod. This configuration is not practical and leads to premature wear of the strap that is systematically pressed against the rod.

It is also apparent from the teaching of the document US 2004/0035992 that replacement of the strap ring necessarily requires the pivot shaft to be disassembled, which implies a good mastery of the reassembly process. As an alternative, the strap is cut and a new strap is then inserted before a stitching step is performed that will define the ring constituting the mechanical continuity.

There again, the stitching process has to be mastered perfectly, which makes a maintenance operation difficult for the final user to perform. No configuration exists in the prior art enabling the final user to fully master maintenance of a camming chock. It should also be emphasized that the variation of length of the textile loop 6*a* implies the use of springs to separate the annular end and the rod in order to stretch the wire element. It is apparent from the configuration illustrated in the document US 2004/0035992 that replacement of the textile loop 6*a* requires a splicing step to be performed after the two springs have been installed, which makes a strap replacement operation almost impossible for an average user.

The invention claimed is:

1. Camming clamping device comprising:

a head sub-assembly including a body and a head, the head being fixed to the body and provided with at least one cam designed to wedge in a crevice, each cam being installed movable around at least one pivot shaft, the body defining a cavity and a hole opening into the cavity;

a rod sub-assembly having a rod installed in the cavity and at least one wire element, the rod being hollow and the at least one wire element passing through the rod, the rod sub-assembly delineating a through hole designed to receive a connector to form an attachment point, the at least one wire element delineating the through hole, the wire element defining at least one loop in the cavity;

a tube installed at an end of the rod, the tube being disposed in the cavity and in the at least one loop, an anchorage passing through the tube and the at least one loop, the anchorage being fixed to the body to constitute a mechanical continuity between the head and the attachment point, the anchorage being different from the at least one pivot shaft.

2. Camming clamping device according to claim 1 wherein the anchorage is removable with respect to the head or destructible independently from the head to allow the head sub-assembly and the rod sub-assembly to be separated.

3. Camming clamping device according to claim 1 wherein the wire element is subjected to a tensile stress in a longitudinal direction of the rod and of the wire element, the rod forming a stop opposing a movement of the tube towards the through hole.

4. Camming clamping device according to claim 1 wherein the wire element has several loops, the tube and the anchorage passing through the several loops.

5. Camming clamping device according to claim 1 wherein the tube is divisible and is installed fixedly in the head and wherein extraction of the tube from the head causes destruction of the tube.

6. Camming clamping device according to claim 1 wherein the anchorage is a screw, and wherein at least one of the head and the tube has a thread receiving a thread of the screw to secure the anchorage with the head.

7. Camming clamping device according to claim 1 wherein the anchorage is an insert crimped with the head.

8. Camming clamping device according to claim 1 wherein the anchorage is a rod fixed to the head by means of an irremovable clip.

9. Camming clamping device according to claim 1 wherein the wire element is a ring made from textile material.

10. Camming clamping device according to claim 1 wherein the wire element is a ring folded to define at least two legs each comprising a top end, a bottom end and two strands, wherein the two strands join one another in the top end to form a loop attached to the head, wherein the bottom end of each leg is extended by a connecting portion, the connecting portion connecting the legs to one another, the connecting portion delineating said through hole, the connecting portion comprising at least four strands of the wire element;

wherein the tube passing through the loops.

11. Camming clamping device according to claim 1 wherein the at least one cam is installed movable swivelling with respect to a body of the head between an extended position and a retracted position, the anchorage being fixed to the body, and a spring is fixed on the one hand to the body and on the other hand to the cam to be able to bias the cam away from the extended position.

12. Method for manufacturing a camming clamping device comprising the following steps:

providing a head sub-assembly including a body and a head, the head being fixed to the body and provided with at least one cam designed to wedge in a crevice, each cam being installed movable around at least one pivot shaft, the body defining a cavity and a hole opening into the cavity;

providing a rod sub-assembly having a rod installed in the cavity and at least one wire element, the rod being hollow and the at least one wire element passing through the rod, the rod sub-assembly delineating a through hole designed to receive a connector to form an attachment point, the at least one wire element delineating the through hole, the wire element defining at least one loop in the cavity, a tube installed at an end of the rod, the tube being disposed in the cavity and in the at least one loop;

fixing an anchorage to the body, the anchorage passing through the tube and the at least one loop to attach the at least one loop to the head sub-assembly and constitute a mechanical continuity between the head and the attachment point.

13. Method for replacing a wire element of a camming clamping device comprising the following steps:

providing a camming clamping device according to claim 1;

removing the anchorage and separating the rod sub-assembly from the head sub-assembly;

providing a new rod sub-assembly having a rod and at least one wire element, the rod being hollow and the at least one wire element passing through the rod, the rod sub-assembly delineating a through hole designed to receive a connector to form an attachment point, the at least one wire element delineating the through hole, the wire element defining at least one loop attached to the head sub-assembly to constitute a mechanical continuity between the head and the attachment point, a tube passing through the at least one loop;

fixing the rod sub-assembly with the head sub-assembly by means of an anchorage fixed to the head and passing through the tube and the at least one loop to constitute a mechanical continuity between the head and the attachment point.

* * * * *